US007445053B2

(12) United States Patent
Matsumoto et al.

(10) Patent No.: US 7,445,053 B2
(45) Date of Patent: Nov. 4, 2008

(54) RIPPING DEVICE FOR AN EARTHMOVING MACHINE

(75) Inventors: Norihisa Matsumoto, Hirakata (JP); Kazuya Arakawa, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/987,307

(22) Filed: Nov. 15, 2004

(65) Prior Publication Data

US 2005/0189125 A1 Sep. 1, 2005

(30) Foreign Application Priority Data

Nov. 21, 2003 (JP) ..... 2003-392318
Oct. 29, 2004 (JP) ..... 2004-314943

(51) Int. Cl.
*A01B 13/08* (2006.01)

(52) U.S. Cl. ..... 172/699; 172/824

(58) Field of Classification Search ..... 172/474, 172/669, 463, 464, 699, 824, 825, 483, 489
See application file for complete search history.

(56) References Cited

U.S. PATENT DOCUMENTS 3,503,456 A 3/1970 Larson
3,527,308 A * 9/1970 Cheers et al. ..... 172/464
3,838,740 A * 10/1974 Rogers ..... 172/439
3,973,632 A * 8/1976 Torazzi ..... 172/464
4,013,129 A * 3/1977 Wilkinson ..... 172/464
4,031,964 A 6/1977 Takahashi et al. ..... 172/9
4,081,035 A * 3/1978 Bowen ..... 172/484
4,120,364 A * 10/1978 Wooldridge ..... 172/2
4,217,962 A * 8/1980 Schaefer ..... 172/197
4,229,044 A 10/1980 Cobb et al. ..... 299/37
4,313,504 A * 2/1982 Fischer ..... 172/382
4,321,970 A * 3/1982 Thigpen ..... 172/464
4,453,600 A * 6/1984 Thigpen ..... 172/250
4,679,857 A 7/1987 Roussin et al. ..... 299/37
4,817,731 A * 4/1989 Karlak ..... 172/464
4,834,461 A 5/1989 Fidler et al. ..... 299/37

(Continued)

FOREIGN PATENT DOCUMENTS

JP 44-5035 3/1969

(Continued)

OTHER PUBLICATIONS

Herbert L. Nichols, Jr.; "Moving The Earth"; 1976, Third Edition, pp. 21-4 and 5; North Castle Books; Connecticut.

*Primary Examiner*—Thomas B Will
*Assistant Examiner*—Jamie L McGowan
(74) *Attorney, Agent, or Firm*—Global IP Counselors, LLP

(57) ABSTRACT

A ripper assembly is arranged in that one end of an arm is pivotally attached to a vehicle body while a beam comprised with shanks is pivotally attached to the other end of the arm, and in that a tilt cylinder and a lift cylinder are respectively interposed between the vehicle body and the beam at a position upward of the arm. One end side of the lift cylinder is pivotally attached, on a vehicle body side, at a position upward of a vehicle body-sided pivotally supporting portion of the tilt cylinder. The other end side of the lift cylinder is pivotally attached, on a beam side, at a position downward of a beam-sided pivotally supporting portion of the tilt cylinder.

12 Claims, 6 Drawing Sheets

U.S. PATENT DOCUMENTS

| | | | | |
|---|---|---|---|---|
| 4,984,850 | A | 1/1991 | Jensen | 299/37 |
| 4,991,659 | A | 2/1991 | Stepe et al. | 172/464 |
| 5,018,792 | A | 5/1991 | Roussin et al. | 299/37 |
| 5,072,993 | A | 12/1991 | Dickerson | 299/37 |
| 5,094,017 | A | 3/1992 | Matsumoto et al. | 37/2 |
| 5,102,200 | A | 4/1992 | Woody | 299/37 |
| 5,293,944 | A | 3/1994 | Matsumoto | 172/2 |
| 5,386,877 | A | 2/1995 | Codina et al. | 172/699 |
| 5,685,377 | A | 11/1997 | Arstein et al. | 172/2 |
| 6,012,535 | A | 1/2000 | Theobald et al. | 172/272 |
| 6,311,784 | B1 * | 11/2001 | Clarke et al. | 172/463 |

FOREIGN PATENT DOCUMENTS

| | | |
|---|---|---|
| JP | 4-122758 | 5/1992 |
| JP | 7-102589 | 4/1995 |

* cited by examiner

RIPPING DEVICE FOR AN EARTHMOVING MACHINE

BACKGROUND OF THE INVENTION

1. Field of the Invention

The present invention relates to a ripping device, and particularly to a ripping device that is used for ripping hard soil and soft rocks as a rear implement for use in an earthworking machine.

2. Description of the Prior Art

A prevailing type of a conventional ripping device was a ripper assembly of four-joint link type in which arms are coupled between lower portions of brackets provided at a vehicle body rear portion of a bulldozer and a lower portion of a beam provided with shanks, and in which hydraulic tilt cylinders are mounted between upper portions of the brackets and an upper portion of the beam. In such a ripping device, hydraulic lift cylinders for coupling the brackets and the beam were mounted between the arms and the hydraulic tilt cylinders. The tilt cylinders are mainly used for moving the shanks backward and forward, and the shaft cylinders for moving the shanks up and down. The brackets are provided at two spots rearward of the vehicle body to be symmetric to the right and left, wherein the brackets and the beam are coupled through the cylinders and the arms as described above, and the shanks was driven by means of total four cylinders. However, in such a conventional type ripping device, upper end positions of the brackets were set to be higher than the rear portion of the vehicle body since it was necessary to set base end portions of the lift cylinders higher for securing lifting force. This arrangement would cause the bracket upper portions or cylinders to hinder the field of view of the operator to make back work difficult. The repairability was also worsened in that detaching of a fuel tank at a rear portion of the vehicle body was difficult due to the presence of the brackets. Since two cylinders and arms exist within an identical vertical place with respect to a traveling direction when seen from the top of the vehicle body, interference of movements of the cylinders or those of the cylinders and the arms would occur so that operating ranges of a ripper tip mounted to a tip end of the shanks could not be expanded for the purpose of preventing interference.

It is known for a device of improved visibility (see, for instance, Japanese Utility Model Registration No. 2,544,731). The ripping device as illustrated in Japanese Utility Model Registration No. 2,544,731 is arranged in that a height of the brackets is set to be lower than a height of a rear portion of the vehicle body of a bulldozer, and in that bottom-sided base ends of the lift cylinders are aligned in parallel with bottom-sided base ends of the tilt cylinders whereupon they are pivotally attached to the brackets by means of the same pins. A tip end of the rod of the tilt cylinders is pivotally attached to an upper end of the beam while a tip end of the rod of the lift cylinders is pivotally attached to somewhat upward of a spot at which the arm is pivotally attached to a lower end of the beam. In Japanese Utility Model Registration No. 2,544,731, rearward visibility in and operability of repair are improved by setting the height of the brackets lower than the height of the rear portion of the bulldozer vehicle body, and by arranging the base end of the tilt cylinders and the base ends of the lift cylinder to be coaxial and pivotally attaching both by the same pins, cuts in costs of parts can be achieved.

Incidentally, the prior art example of Japanese Utility Model Registration No. 2,544,731 employs a structure in which a four-joint link is comprised by the tilt cylinders and the arms, and wherein the lift cylinders are mounted inside of the four-joint link when seen from a side with respect to a traveling direction of the vehicle body. Accordingly, a problem is provided that thrust of the lift cylinders will be extremely large when performing lifting movements of the ripper tip, which are movements of the ripper that require the largest cylinder thrust so that it will be necessary to set a large thrust spec for the cylinders which will result in a growth in size of the entire device. Moreover, since the bottom-sided based end of the tilt cylinders and the bottom-sided base of the lift cylinders are coaxial in the structure of Japanese Utility Model Registration No. 2,544,731, drawbacks are presented in that the operating range of the ripper tip will be restricted due to the necessity of avoiding interference of respective cylinders. The rearward visibility was also still worsened since a total of four cylinders were employed with alignments of the cylinders being symmetrical to the right and left.

The present invention has been made for solving the above-described conventional problems, and it is an object thereof to provide a ripping device that can be downsized with respect to a conventional ripper and that is capable of expanding the operational range of a ripper tip. It is also an object of the present invention to provide a ripping device that is capable of improving rearward visibility.

SUMMARY OF THE INVENTION

In accordance with one aspect of the present invention,a ripping device is arranged in that one end of an arm is pivotally attached to a vehicle body, in that a beam comprised with shanks is pivotally attached to the other end of the arm, and in that a hydraulic tilt cylinder and a hydraulic lift cylinder are respectively interposed between the vehicle body and the beam at a position upward of the arm, wherein one end side of the hydraulic lift cylinder is pivotally attached, on the vehicle body side, at a position upward of a pivotally supporting portion of the hydraulic tilt cylinder on the vehicle body side while the other end side of the hydraulic lift cylinder is pivotally attached, on the beam side, at a position downward of a pivotally supporting portion of the hydraulic tilt cylinder on the beam side.

In accordance with another aspect of the present invention,a ripping device is arranged in that one hydraulic tilt cylinder and one hydraulic lift cylinder each are respectively mounted.

In accordance with still another aspect of the present invention,a ripping device arranged in that one end of an arm is pivotally attached to a vehicle body, in that a beam comprised with shanks is pivotally attached to the other end of the arm, and in which a rod of fixed length and a hydraulic lift cylinder are respectively interposed between the vehicle body and the beam at a position upward of the arm, wherein one end side of the hydraulic lift cylinder is pivotally attached, on the vehicle body side, at a position upward of a vehicle body-sided supporting portion of the rod while the other end side of the hydraulic lift cylinder is pivotally attached, on the beam side, at a position downward of a beam-sided supporting portion of the rod on the beam side.

In accordance with yet another aspect of the present invention,a ripping device is arranged in that one rod of fixed length and one hydraulic lift cylinder each are respectively mounted.

According to one aspect of present invention, the cylinders are mounted such that a central axial line of the tilt cylinder and an a central axial line of the lift cylinder intersect when seen from a side with respect to a moving direction of, for instance, a bulldozer, so that vertical directional components of a thrust vector of the lift cylinder becomes large when performing lifting of the ripper tip, which requires the largest cylinder thrust from among movements of both cylinders, whereby vertical directional components of a resultant force vector of the cylinders become large. In other words, when performing lifting of the ripper tip that requires the largest cylinder thrust, vertical directional components of the thrust vector of the lift cylinder, which mainly bears the load, become large so that the vertical directional components of a resultant force vector of the cylinders become large. Accordingly, the lift cylinder thrust required at the time of lifting can be made small and the maximum value of load borne by the lift cylinder can be reduced. It is therefore possible to reduce the maximum designed thrust for the cylinder and thus to achieve downsizing of the lift cylinder. Accordingly, the rearward visibility can be improved even if two tilt cylinders and two lift cylinders were mounted similar to the prior art since both cylinders can be downsized with respect to those of the prior art.

In addition, the tilt cylinder and the lift cylinder are disposed in parallel such that both cylinders do not overlap when seen from the top of the vehicle body. Accordingly, even when the cylinders expand and contract and rotate in vertical directions, it is possible to prevent interference between both cylinders and it is accordingly possible to expand the operating range of the ripper tip.

According to another aspect of the invention, the number of cylinders mounted is set to be two, which is a minimum required number for driving the shanks, so that it is possible to widen the rearward field of view and also to reduce the number of parts. Accordingly, it is possible to improve the workability of ripping and to reduce manufacturing costs.

According to still another of the invention, the lift cylinder and others are mounted such that a central axial line of the rod and a central axial line of the lift cylinder intersect when seen from a side with respect to a moving direction of, for instance, a bulldozer, so that vertical directional components of a thrust vector of the lift cylinder becomes large when performing lifting of the ripper tip, which requires the largest cylinder thrust, whereby vertical directional components of a resultant force vector of the rod and the cylinder becomes large. Accordingly, the lift cylinder thrust required at the time of lifting can be made small, and the maximum value of load borne by the lift cylinder can be reduced. It is therefore possible to reduce the maximum designed thrust for the cylinder and thus to achieve downsizing of the lift cylinder. Accordingly, the rearward visibility can be improved since the lift cylinder can be downsized with respect to that of the prior art. Moreover, the ripper tip performs parallel movements in vertical directions without changing its posture with respect to the ground surface accompanying expanding and contracting movements of the lift cylinder. The inclination angle of the ripper tip is thus continuously constant irrespective of inclination depth. It is also possible to perform lifting (ripping) operations in a strong and stable manner.

According to yet another aspect of the present invention, there are provided one lift cylinder and one rod each so that it is possible to reduce the number of parts and to widen the rearward field of view. It is therefore possible to improve the workability and to reduce manufacturing costs.

Other aspects,objects and advantages of the invention will become apparent from the following description,drawings and appended claims.

DESCRIPTION OF THE PREFERRED EMBODIMENTS

Figure 1:
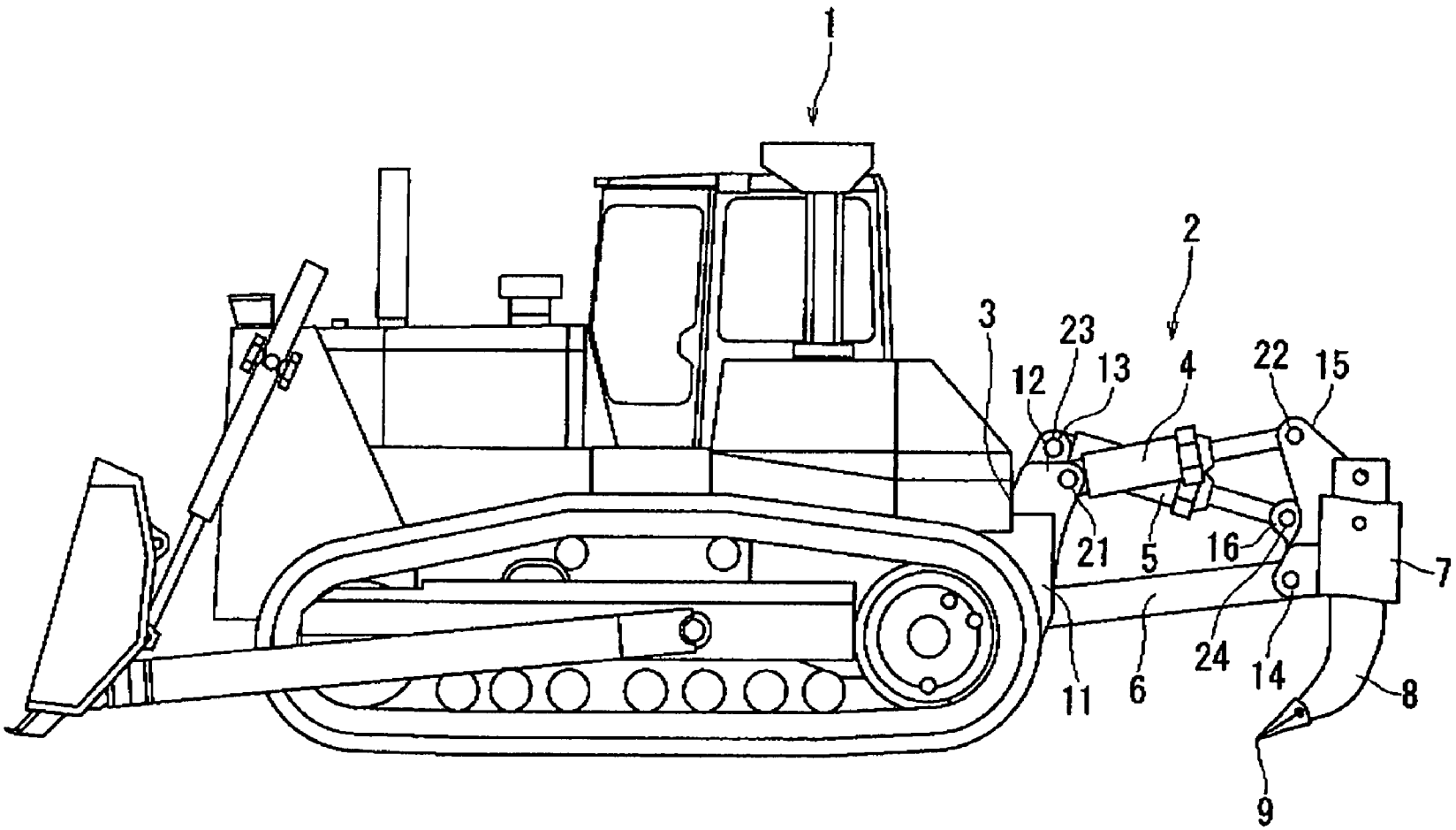
FIG. 1 is a side view of a bulldozer mounted with one embodiment of the ripping device of the present invention.
Figure 2:
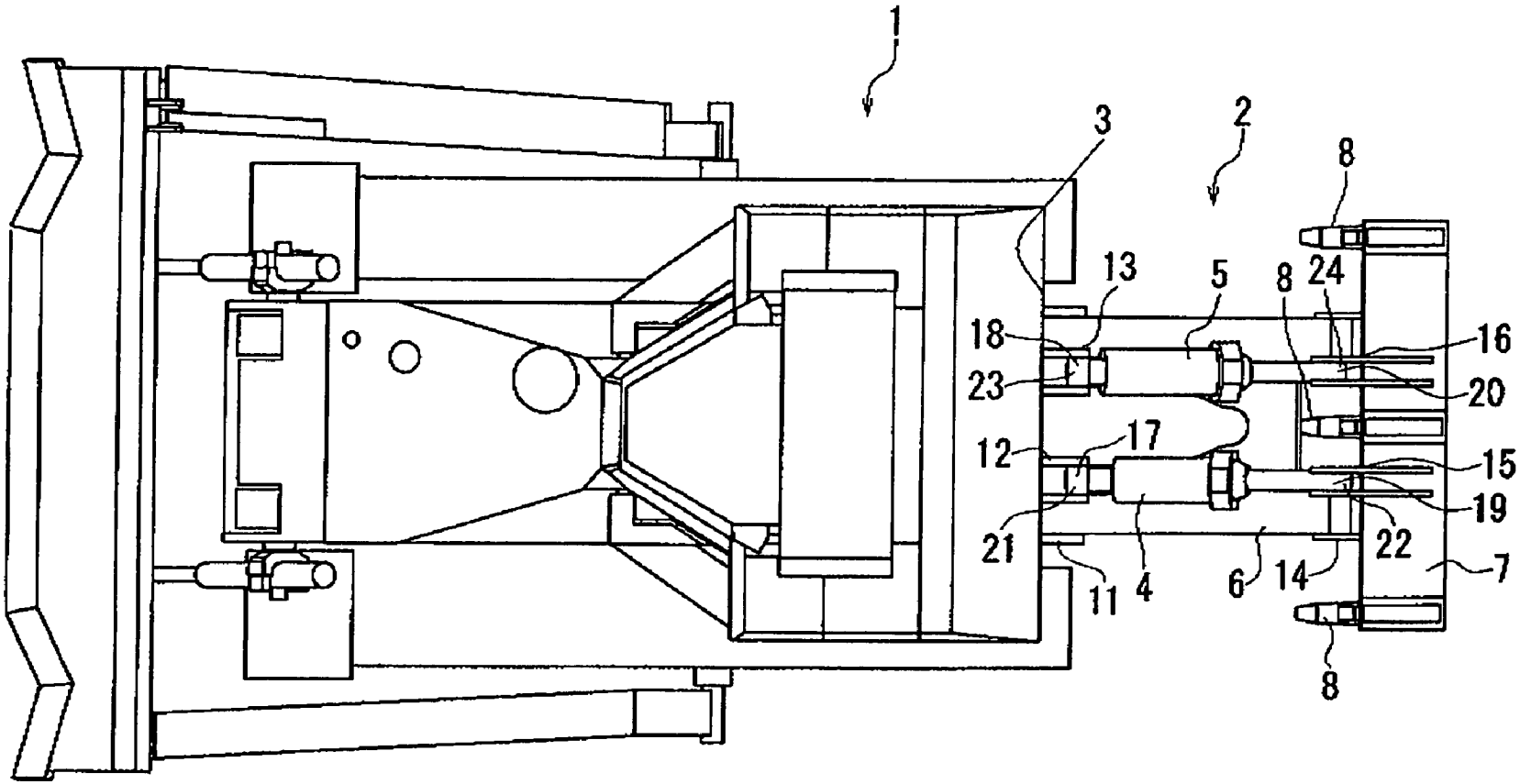
FIG. 2 is a plan view of the bulldozer.

A concrete embodiment of the ripping device according to the present invention will now be described in details with reference to the drawings. One embodiment of the present invention is illustrated in FIGS. 1 and 2. FIG. 1 is a side view of a bulldozer 1 mounted with a ripping device 2, and FIG. 2 is a plan view of the bulldozer 1. As illustrated in FIGS. 1 and 2, one end of an arm 6 is pivotally attached to a vehicle body rear portion 3 of the bulldozer 1 through a bracket 11, and the other end of the arm 6 is pivotally attached to a lower portion 14 of a beam 7 including three shanks 8. Upward of the arm 6, a hydraulic tilt cylinder 4 and a hydraulic lift cylinder 5 are mounted and connected between the vehicle body rear portion 3 and the beam 7 in a parallel manner in a traveling direction when seen from the top of the vehicle body.

A bottom-sided base end 17 of the tilt cylinder 4 is pivotally attached to the vehicle body rear portion 3 by means of a bracket 12. A rod tip end 19 of the tilt cylinder 4 is pivotally attached to a beam upper portion 15. On the other hand, a bottom-sided base end 18 of the lift cylinder 5 on the bottom side is pivotally attached upward of the vehicle body rear portion 3 by means of a bracket 13, and a rod tip end 20 of the lift cylinder 5 is pivotally attached to a beam intermediate portion 16. A characteristic point is here that the bottom-sided base end 18 of the lift cylinder 5 is pivotally attached to an obliquely upper portion of the bottom-sided base end 17 of the tilt cylinder 4 with respect to the vehicle body rear portion 3. Another point is it that the rod tip end 19 of the tilt cylinder 4 is pivotally attached to the beam upper portion 15 on the beam 7 side of the ripping device 2 while the rod tip end 20 of the lift cylinder 5 is pivotally attached to the beam intermediate portion 16 that is located at an obliquely lower position than the rod tip end 19 of the tilt cylinder 4 but upward of the end portion of the arm 6. In other words, one end side of the lift. cylinder 5 is pivotally attached, on the vehicle body side (that is, the pivotally supporting portion 23 side on the vehicle body side), at a position upward than a vehicle body-sided pivotally supporting portion 21 of the tilt cylinder 4 while the other end side of the lift cylinder 5 is pivotally attached, on the beam side (that is, the pivotally supporting portion 24 on the beam side), at a position downward of the beam-sided pivotally supporting portion 22 of the tilt cylinder 4, respectively. As a result, the cylinders are mounted such that a central axial line of the tilt cylinder 4 and a central axial line of the shift cylinder 5 intersect when seen from a side with respect to a traveling direction of the vehicle body as illustrated in FIG. 1. There are provided one tilt cylinder 4 and one lift cylinder 5 each, and their bottom-sided base ends are mounted that they are located at even intervals to the right and left of the central line of the vehicle body that is parallel to the traveling direction as illustrated in FIG. 2. In other words, the tilt cylinder 4 and the lift cylinder 5 are disposed in parallel such that they do not overlap when seen from the top of the vehicle body.

When operating the ripping device 2, thrusts of the respective cylinders necessary for generating cutting edge force of a ripper tip 9 and reaction force acting on the arm 6 are compared with those of a conventional ripper assembly of four-joint link structure and considered. Operations of the ripper tip 9 to be considered are lifting operations of the ripper tip 9 at which the load applied to the lift cylinder 5 becomes largest and operations during traction movements of the ripper tip 9 at which the load applied to the tilt cylinder 4 becomes largest.

Figure 3:
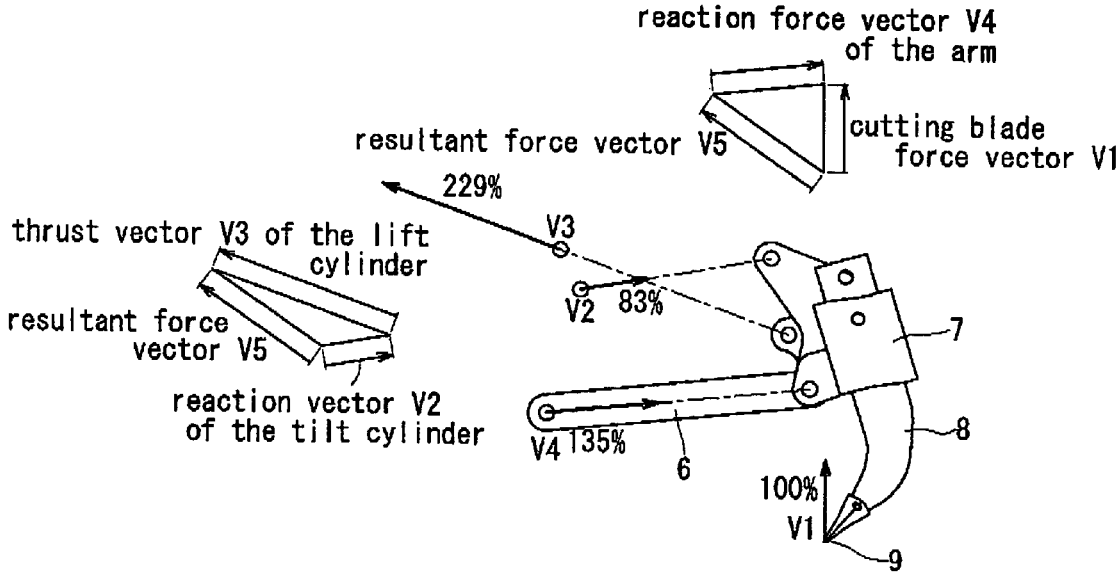
FIG. 3 are vector diagrams illustrating force acting on respective members when performing lifting with the ripping device of the present embodiment.
Figure 4:
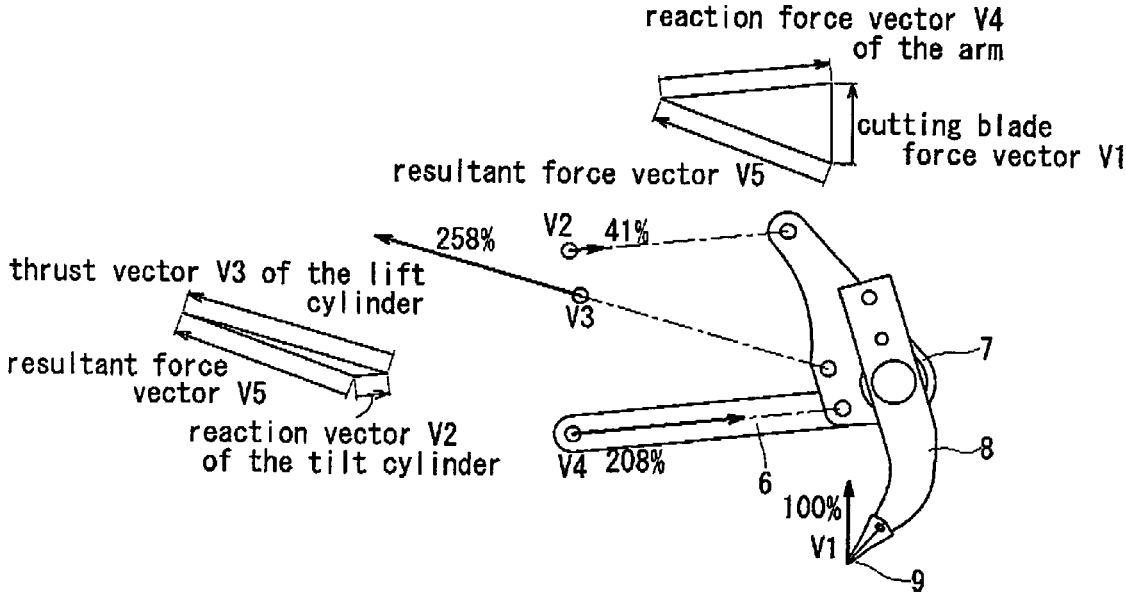
FIG. 4 are vector diagrams illustrating force acting on respective members when performing lifting with a conventional ripping device.

Lifting operations of the ripper tip 9 will first be considered. Vector diagrams of force acting on respective members when performing lifting operations of the ripper tip 9 of the above-described embodiment are illustrated in FIG. 3 while those of the prior art are illustrated in FIG. 4. In both cases of FIGS. 3 and 4, a sum of a reaction force vector V4 of the arm 6 and a cylinder resultant force vector V5 is in balance with a cutting blade force vector V1 of the ripper tip 9. The cylinder resultant force vector V5 is given by a reaction force vector V2 of the tilt cylinder 4 and a thrust vector V3 of the lift cylinder 5. Provided that the cutting blade force required for performing lifting operations of the ripper tip 9 is given as load 100%, the reaction force vector V4 of the arm 6, a reaction force vector V2 of the tilt cylinder 4 and a thrust vector V3 required for the lift cylinder 5 were considered. As illustrated in FIGS. 3 and 4, force required for the lift cylinder 5 becomes largest when performing lifting operations, and the lift cylinder 5 plays a major role. As illustrated in FIG. 4, hardly any force acts on the tilt cylinder 4 when performing lifting operations of the ripper tip 9 in a conventionally arranged ripping device. Since an angle formed by the reaction vector V2 of the tilt cylinder 4 and the thrust vector V3 of the lift cylinder 5 is small and vertical directional components of the thrust vector V3 of the lift cylinder 5 are small, vertical directional components of the resultant force vector V5 of the cylinder become small. Accordingly, for generating a cutting edge force of 100%, the lift cylinder 5 requires a thrust of 258% and the tiltcylinder 4 requires a reaction force of 41%. The arm reaction force at this time was 208%. On the other hand, in the embodiment of the present invention as illustrated, in FIG. 3, an angle formed by the reaction vector V2 of the tilt cylinder 4 and the thrust vector V3 of the lift cylinder 5 becomes larger than that of the prior art, and vertical directional components of the thrust vector V3 of the lift cylinder 5 also become large so that the vertical direction components of the resultant force vector V5 of the cylinder becomes accordingly large. Therefore, the thrust required for the lift cylinder will be 229 & so that the same cutting edge force V1 may be generated with a thrust that is less than that of the prior art by 12%. In this respect, the reaction force of the tilt cylinder 4 of the present embodiment will be 83% and thus increased to twice its force when compared to that of the prior art, and the tilt cylinder 4 is effectively utilized. On the other hand, the arm reaction force is remarkably reduced to 135% so that contribution to lifting operations was degraded.

Figure 5:
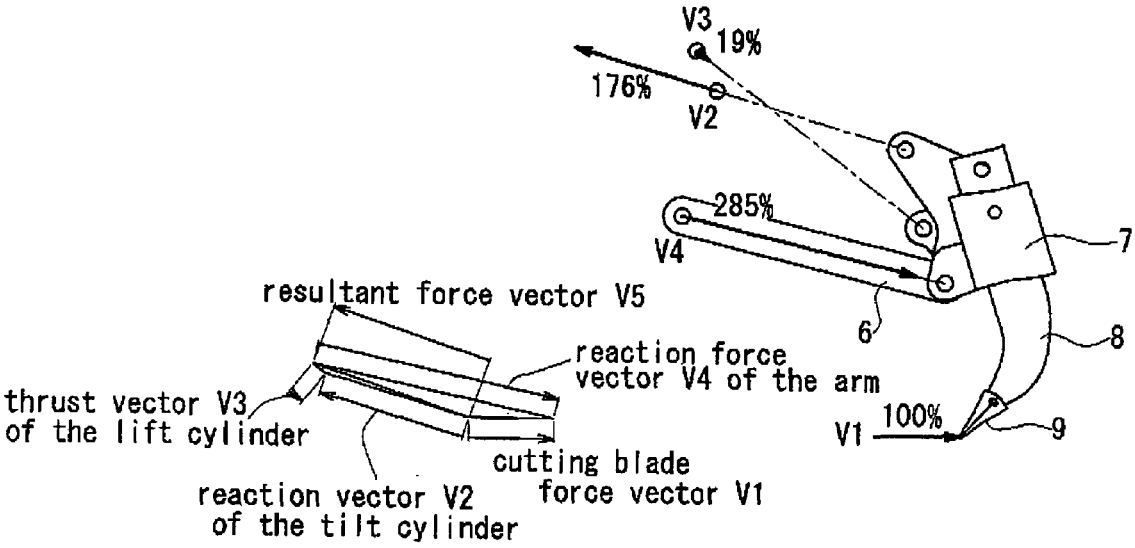
FIG. 5 are vector diagrams illustrating force acting on respective members when performing traction movements with the ripping device of the present embodiment.
Figure 6:
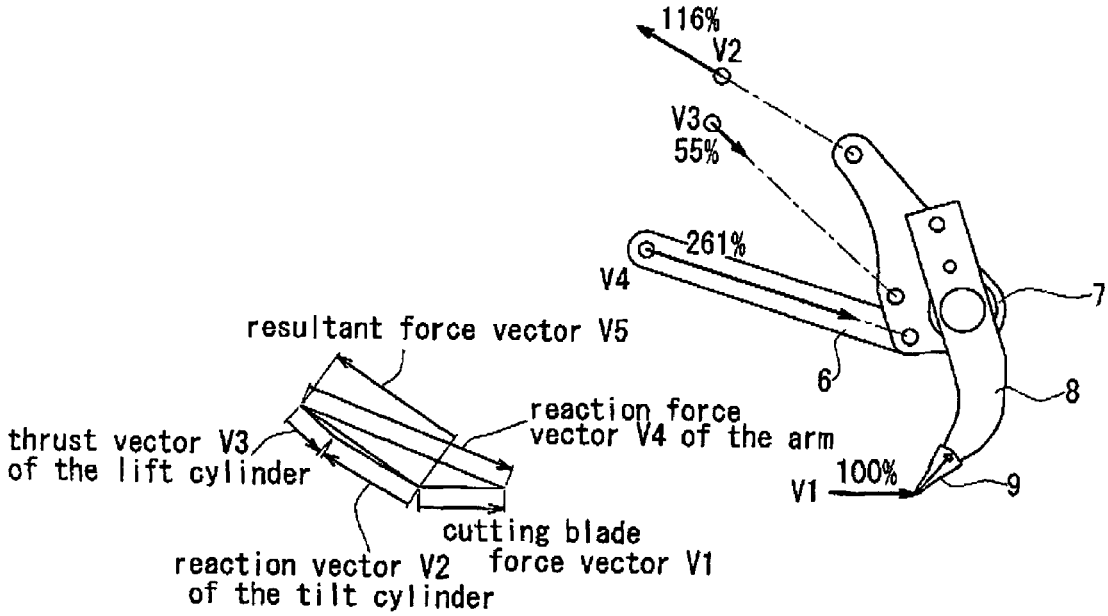
FIG. 6 are vector diagrams illustrating force acting on respective members when performing traction movements with a conventional ripping device.

A case when the ripper tip 9 performs traction operations will now be considered. Vector diagrams when the ripper tip 9 is performing traction operations in the present embodiment are illustrated in FIG. 5 while those of the prior art are illustrated in FIG. 6. In both of FIGS. 5 and 6, a sum of the reaction vector V4 of the arm 6 and a cylinder resultant force vector V5 is in balance with the cutting edge force vector V1 of the ripper tip 9. The cylinder resultant force vector V5 is given by the thrust vector V2 required for the tilt cylinder 4 and the reaction force vector V3 of the lift cylinder 5. Provided that the cutting edge force required for performing traction operations of the ripper tip 9 is given as load 100%, the reaction force vector V4 of the arm 6, the thrust vector V2 of the tilt cylinder 4 and the reaction force vector V3 required for the lift cylinder 5 were considered. As illustrated in FIGS. 5 and 6, the arm reaction force V4 becomes largest when performing traction operations. Accordingly, load borne by the tilt cylinder 4 and the lift cylinder 5 becomes smaller when compared to the load when performing lifting operations in both of the ripping device according to the embodiment of the present invention as illustrated in FIG. 5 and that of the prior art structure as illustrated in FIG. 6. In the ripping device of the prior art structure of FIG. 6, the reaction force of the lift cylinder 5 is 55% while the reaction force of the lift cylinder 5 is 19% in the embodiment of the present invention of FIG. 5 so that it hardly contributes to the traction operations. Accordingly, while the thrust required for the tilt cylinder 4 is 116% in the prior art ripping device of FIG. 6, that of the embodiment of the present invention of FIG. 5 will be 176%, and the load borne by the tilt cylinder 4 is increased. However, while the arm reaction force is conventionally 261%, that of the embodiment of the present invention is slightly increased to 285%. In other words, while the reaction force of the tilt cylinder 4 increases up to 176%, the increase in arm reaction force (9%) will make it possible to receive the load at a position close to the center of gravity of the vehicle body.

As it has become evident from FIGS. 3 to 6, operations of the ripper tip 9 mostly requiring thrust at the cylinders are lifting operations of the ripper tip 9 and the lift cylinder 5 requires a thrust of not less than 200%. In the embodiment of the present invention, the thrust of the lift cylinder 5 could be reduced to as little as 229% when performing lifting operations. In other words, by reducing the cylinder maximum thrust of the ripper tip 9 at a the time of lifting, the designed performance of the cylinders can be reduced to thereby reduce the maximum designed thrust for the cylinders and thus to achieve downsizing of the cylinders and to reduce costs of parts. While the arm reaction force increased by 9% when performing traction operations of the ripper tip 9 in the present embodiment, load can be received at a position close to the center of gravity of the vehicle body so that it is possible to perform traction operations in a stable manner.

Figure 7:
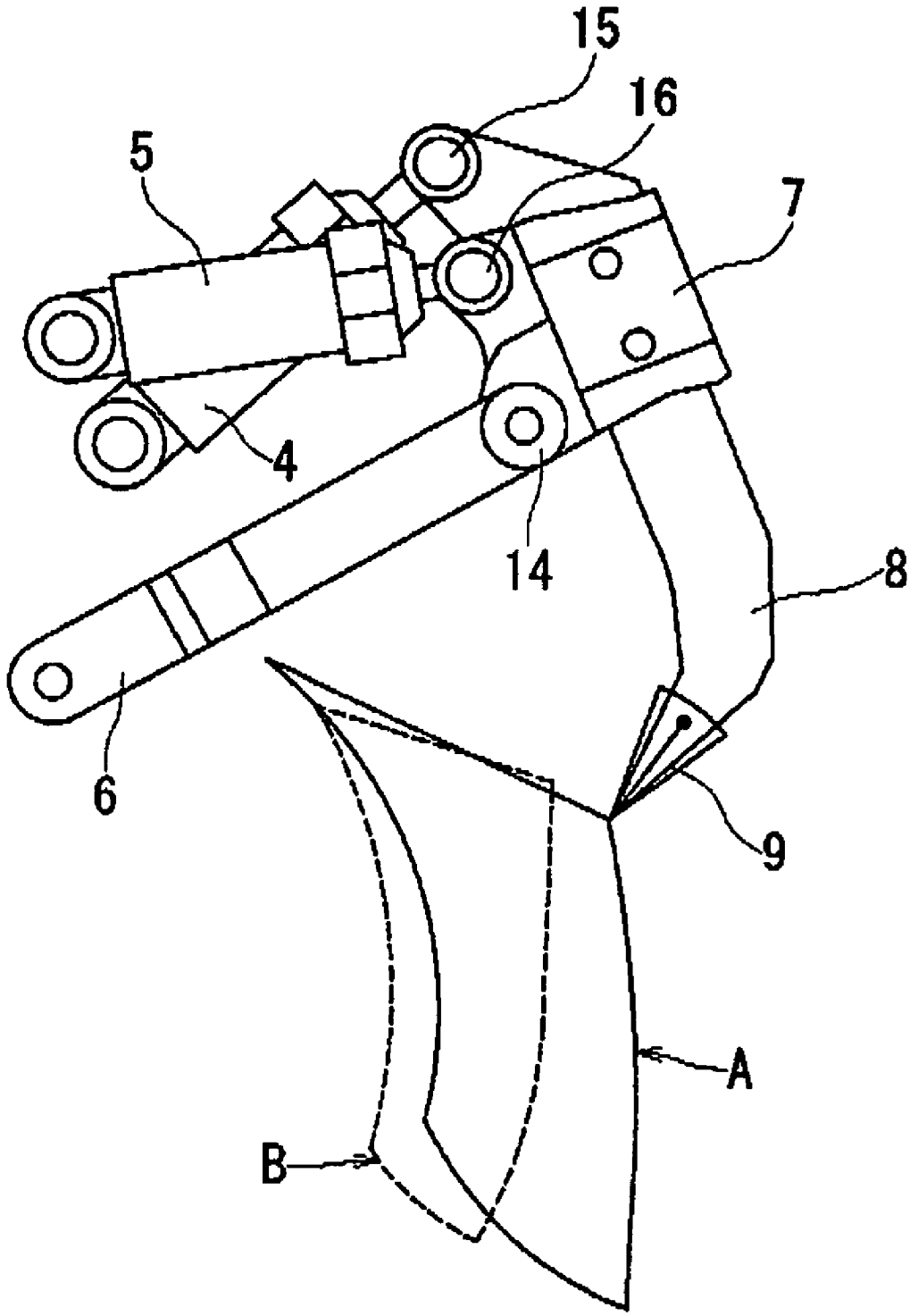
FIG. 7 is a side view illustrating an operating range of a ripper tip.

A side view of the ripping device 2 illustrating operating areas of the ripper tip 9 is illustrated in FIG. 7. The solid line in FIG. 7 illustrates an operable range A for the ripper tip 9 in the embodiment of the present invention while the broken line illustrates an operable range B for the ripper tip 9 of a ripping device of prior art structure. As it can be understood from the drawing, the operable range for the ripper tip 9 is increased in the embodiment of the present invention. This is because the degree of freedom of cylinder operations has been increased since one of the tilt cylinder 4 and the lift cylinder 5 each are provided so that the number of cylinders are two, and since respective bottom-sided base ends are mounted at even intervals to the right and left of the central line of the vehicle body rear portion 3 in the traveling direction, the cylinders do not interfere with each other even if the respective cylinders perform rotating movements in vertical directions with their bottom-sided base ends being the center as illustrated in FIG. 2. Accordingly, the workability of the ripping device of the embodiment of the present invention can be remarkably increased. Further, a ripper link is comprised by disposing two cylinders, one tilt cylinder 4 and one lift cylinder 5 each, to be non-symmetric to the right and left, it is possible to secure rearward visibility.

Figure 8:
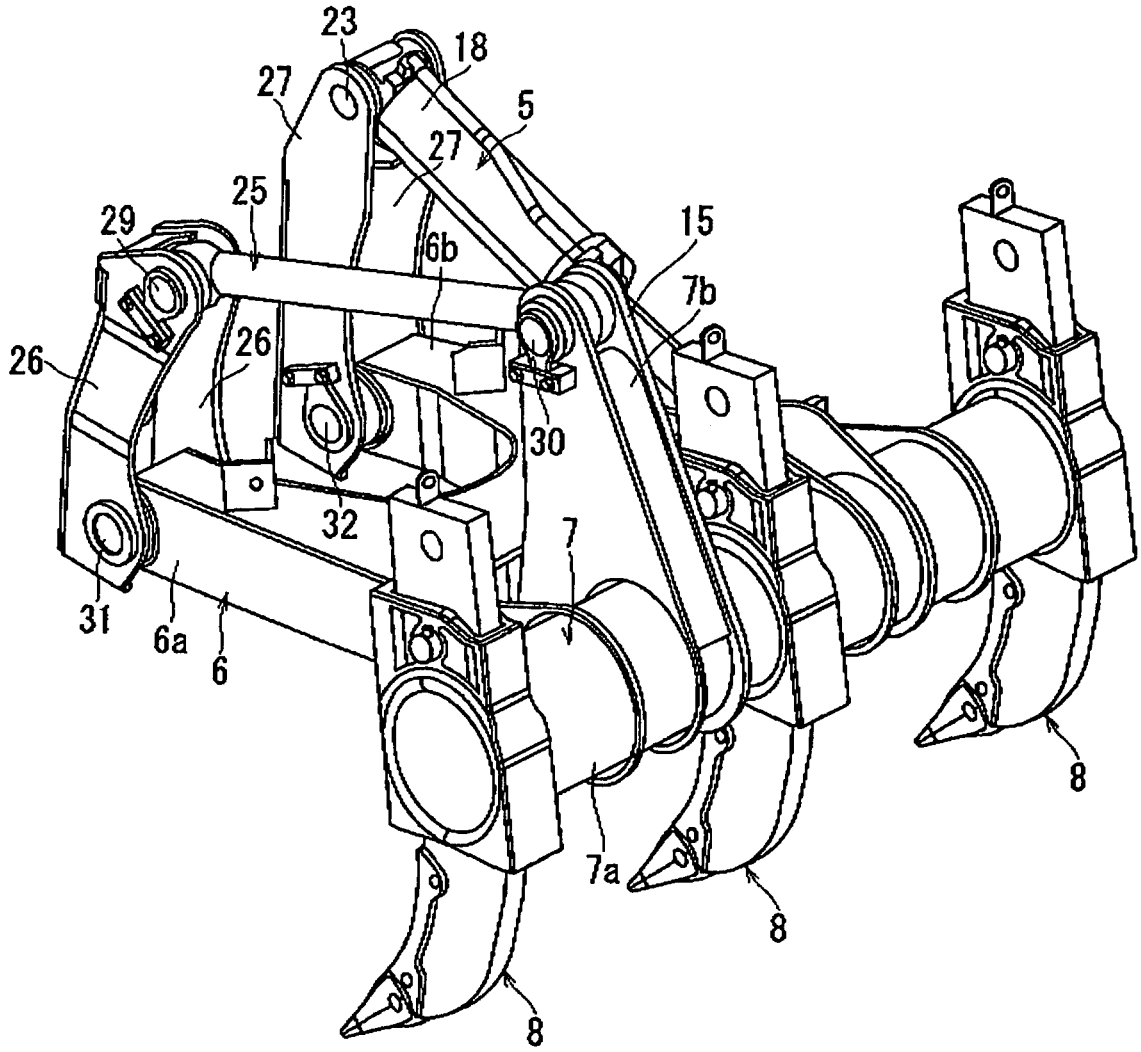
FIG. 8 is a perspective view illustrating another embodiment of the ripping device according to the present invention.

Next, FIG. 8 illustrates another embodiment wherein a rod (link) 25 of fixed length is employed instead of a tilt cylinder 4. More particularly, one end portion of the rod 25 is pivotally attached to upper end portions of brackets 26, 26 of a vehicle body rear portion 3 while the other end portion of the rod 25 is pivotally attached to a beam upper portion 15 (upper portion of supporting piece portion 7*b* formed to project from a beam main body 7*a*) The rod 25 and an arm 6 and other parts similarly comprise a four-joint link. A bottom-sided base end 18 of a lift cylinder 5 is pivotally attached to upper end portions of brackets 27, 27 and a lift cylinder rod tip end 20 of the lift cylinder 5 is pivotally attached to a beam intermediate portion 16 (not shown) In this respect, the arm 6 comprises one pair of coupling piece portions 6*a*, 6*a* wherein one coupling piece portion 6*a* of the arm 6 and lower end portions of the brackets 26, 26 are pivotally attached through a pivot shaft 31 while the other coupling piece portion 6*b* of the arm 6 and lower end portions of the brackets 27, 27 are pivotally attached through a pivot shaft 32.

At this time, the one end side of the lift cylinder 5 is pivotally attached, on a vehicle body side (that is, a pivot-supporting portion 23 side on the vehicle body side) at a position upward than a vehicle body-sided supporting portion 29 on the one end portion side of the rod 25 while the other end side of the lift cylinder 5 is pivotally attached, on a beam 7 side (that is, a pivot-supporting portion 24 side on the beam side, not shown) at a position downward than a beam-sided supporting portion 30 of the rod 25 on the other end portion side, respectively. Further, the rod 25 and the lift cylinder 5 are disposed in parallel such that the cylinders do not overlap when seen from the top of the vehicle body.

According to the ripping device as illustrated in FIG. 8, the ripper tip 9 performs parallel movements in vertical directions without changing its positions with respect to the ground surface accompanying expanding and contracting movements of the lift cylinder 5. Accordingly, the angle of inclination of the ripper tip 9 is continuously stable irrespective of the depth of inclination. It is possible to perform lifting (ripping) operations in a strong and stable manner. Moreover, vertical direction components of the thrust vector of the lift cylinder 5 will similarly become large when performing lifting of the ripper tip 9 which requires the largest cylinder thrust also in this case so that vertical direction components of resultant force vector of the rod 25 and the lift cylinder 5 become large. Accordingly, the lift cylinder thrust required for lifting can be made small so that the maximum value of load that is borne by the lift cylinder 5 can be made small. With this arrangement, the maximum designed thrust of the lift cylinder 5 can be made small so that it is possible to achieve downsizing of the lift cylinder 5. Since the lift cylinder 5 can be downsized when compared to the prior art, it is possible to improve the rearward visibility.

Since the rod 25 and the lift cylinder 5 are disposed in parallel such that the cylinders do not overlap when seen from the top of the vehicle body, the cylinder 5 will not interfere the rod 25 also when the cylinder 5 performs expanding and contracting movements, and lifting operations can be performed in a stable manner. Moreover, since there are provided one lift cylinder and one rod 25 each, it is possible to reduce the number of parts to thus widen the rearward field of view. It is therefore possible to improve the workability and to reduce manufacturing costs.

While concrete embodiments of the ripping device 2 according to the present invention have been explained so far, the present invention is not limited to the above embodiments alone but may be embodied upon variously modifying the same within the scope of the present invention. For instance, while there were mounted one tilt cylinder 4 and one lift cylinder 5 each at even intervals with respect to a central line of the vehicle body rear portion 3 in the traveling direction thereof in the embodiment as illustrated in FIG. 1 and others, the cylinders may be disposed at arbitrary positions as long as the mounted cylinders do not interfere with each other and vertical positional relations between the base end portions of the tilt cylinder 4 and the lift cylinder 5 and the rod tip end portion are maintained. Further, while two cylinders are mounted for operating the shanks 8 in the embodiment as illustrated in FIG. 1 and others, it is possible to mount a plurality of tilt cylinders 4 and lift cylinders 5 to the vehicle body rear portion through cylinder mounting methods similar to those of the above embodiments in case of, for instance, a further large-sized multi-shank ripper that requires a larger cylinder thrust. More particularly, also in case two tilt cylinders 4 and two lift cylinders 5 are mounted as in the prior art, the cylinders can be downsized as compared to those of the prior art so that the rearward visibility is improved. As illustrated in FIG. 8, also in case of a ripping device that is comprised with a rod 25, the device may including a plurality of rods 25 and a plurality of lift cylinders 5. Moreover, while the above descriptions illustrate cases in which the invention is applied to a bulldozer, it may also be another type of earthmoving machines.

What is claimed is:

1. A ripping device comprising:

a vehicle body of an earthmoving vehicle;

a beam;

a shank mounted on the beam;

an arm including a first attachment end pivotally coupled to the vehicle body about a first pivot axis, and a second attachment end pivotally coupled to the beam about a second pivot axis;

a single hydraulic tilt cylinder disposed only on a first side with respect to a longitudinal vertical center plane of the ripping device and spaced apart from the longitudinal vertical center plane, the hydraulic tilt cylinder including a first tilt cylinder end pivotally coupled to the vehicle body about a third pivot axis and a second tilt cylinder end pivotally coupled to the beam about a fourth pivot axis; and a single hydraulic lift cylinder disposed only on a second side with respect to the longitudinal vertical center plane of the ripping device and spaced apart from the longitudinal vertical center plane, the hydraulic lift cylinder including a first lift cylinder end configured to be pivotally coupled to the vehicle body about a fifth pivot axis and a second lift cylinder end pivotally coupled to the beam about a sixth pivot axis;

the fifth pivot axis of the first lift cylinder end of the hydraulic lift cylinder being located upward of the third pivot axis of the first tilt cylinder end of the hydraulic tilt cylinder, and the sixth pivot axis of the second lift cylinder end of the hydraulic lift cylinder being located downward of the fourth pivot axis of the second tilt cylinder end of the hydraulic tilt cylinder.

2. The ripping device as claimed in claim 1, wherein the hydraulic lift cylinder is disposed on a right-hand side with respect to the longitudinal vertical center plane of the ripping device.

3. The ripping device as claimed in claim 2, wherein the hydraulic lift cylinder and the hydraulic tilt cylinder have center axes that are evenly spaced apart from the longitudinal vertical center plane of the ripping device.

4. The ripping device as claimed in claim 1, wherein the vehicle body has connection points of the hydraulic tilt cylinder and the hydraulic lift cylinder that are evenly spaced apart from a longitudinal vertical center plane of the ripping device.

5. The ripping device as claimed in claim 1, wherein the beam is non-symmetrical with respect to connection points of the hydraulic tilt cylinder and the hydraulic lift cylinder such that an uppermost surface of a portion of the beam that is aligned with the hydraulic lift cylinder is at a lower level than an uppermost surface of a portion of the beam that is aligned with the hydraulic tilt cylinder.

6. The ripping device as claimed in claim 1, wherein the arm has an opening along the longitudinal vertical center plane of the ripping device, and the shank is a center shank disposed on the longitudinal center plane.

7. A ripping device comprising:

a vehicle body of an earthmoving vehicle;

a beam;

a shank mounted on the beam;

an arm including a first attachment end pivotally coupled to the vehicle body about a first pivot axis, and a second attachment end pivotally coupled to the beam about a second pivot axis;

a single fixed length rod disposed only on a first side with respect to a longitudinal vertical center plane of the ripping device and spaced apart from the longitudinal vertical center plane, the fixed length rod including a first rod end pivotally coupled to the vehicle body about a third pivot axis and a second rod end pivotally coupled to the beam about a fourth pivot axis with a distance between the third and fourth pivot axes being a fixed length; and a single hydraulic lift cylinder disposed only on a second side with respect to the longitudinal vertical center plane of the ripping device and spaced apart from the longitudinal vertical center plane, the hydraulic lift cylinder including a first lift cylinder end configured to be pivotally coupled to the vehicle body about a fifth pivot axis and a second lift cylinder end pivotally coupled to the beam about a sixth pivot axis;

the fifth pivot axis of the first lift cylinder end of the hydraulic lift cylinder being located upward of the third pivot axis of the first rod end of the fixed length rod, and the sixth pivot axis of the second lift cylinder end of the hydraulic lift cylinder being located downward of the fourth pivot axis of the second rod end of the fixed length rod.

8. The ripping device as claimed in claim 7, wherein the hydraulic lift cylinder is disposed on a right-hand side with respect to the longitudinal vertical center plane of the ripping device.

9. The ripping device as claimed in claim 8, wherein the hydraulic lift cylinder and the fixed length rod have center axes that are evenly spaced apart from the longitudinal vertical center plane of the ripping device.

10. The ripping device as claimed in claim 7, wherein the vehicle body has connection points of the fixed length rod and the hydraulic lift cylinder that are evenly spaced apart from a longitudinal vertical center plane of the ripping device.

11. The ripping device as claimed in claim 7, wherein the beam is non-symmetrical with respect to connection points of the fixed length rod and the hydraulic lift cylinder such that an uppermost surface of a portion of the beam that is aligned with the hydraulic lift cylinder is at a lower level than an uppermost surface of a portion of the beam that is aligned with the fixed length rod.

12. The ripping device as claimed in claim 7, wherein the arm has an opening along the longitudinal vertical center plane of the ripping device, and the shank is a center shank disposed on the longitudinal center plane.

* * * * *